United States Patent [19]

Michael

[11] 3,948,523

[45] Apr. 6, 1976

[54] LIGHTED ROTATING FLYING BODY

[76] Inventor: Henry G. Michael, 1724 Yorkshire, Birmingham, Mich. 48008

[22] Filed: Aug. 5, 1974

[21] Appl. No.: 494,926

[52] U.S. Cl. ..... 273/106 B; 46/74 D; 46/228

[51] Int. Cl.[2] ..... A63H 27/12

[58] Field of Search ..... 273/106 B; 46/74 D, 228

[56] References Cited

UNITED STATES PATENTS

| | | | |
|---|---|---|---|
| 2,611,214 | 9/1952 | Schur | 46/228 |
| 2,739,419 | 3/1956 | Cleveland | 46/228 |
| 3,359,678 | 12/1967 | Headrick | 46/74 D |
| 3,531,892 | 10/1970 | Pearce | 46/228 |
| 3,720,018 | 3/1973 | Peterson et al. | 46/74 D |
| 3,786,246 | 1/1974 | Johnson et al. | 273/106 B UX |
| 3,798,834 | 3/1974 | Samuel | 46/74 D |

*Primary Examiner*—Paul E. Shapiro

[57] ABSTRACT

A rotating flying body having three dish-like body members connected together to form a hollow cavity between two of the body members, the third body member extending radially outwardly from the periphery of the two members forming the cavity. Two dry cell batteries and a light bulb in electrical connection therewith are located in the cavity along with an electric switch which is actuated by rotating one of the body members with respect to the other to close the electric circuit and light the bulb.

7 Claims, 5 Drawing Figures

LIGHTED ROTATING FLYING BODY

BACKGROUND OF THE INVENTION

I. Field of the Invention

The present invention relates to amusement or recreational devices, particularly to projectiles used in aerial games.

II. Description of the Prior Art

The prior art includes lighted rotating toys such as tops and yo-yo's, however, none of these prior art toys are capable of free flight. The prior art also includes nonlighted rotating free flight bodies.

SUMMARY OF THE INVENTION

The present invention provides a rotating free flight body which can be illuminated to be used in darkness, providing a number of new games, tests of skill, or extensions of known games limited only by the user's imagination. Further, the present invention provides varied visual illusions which will account for added hours of amusement for both adults and children.

The present invention comprises a rotating free flight flying body having at least two, but preferably three dish-like body members; a top body member, a bottom body member and a lifting body member. The bottom and top body members fit together to form a cavity and a peripheral groove therebetween in which to receive and retain the lifting body member which extends peripherally outwardly from them. Two dry cell batteries, a light bulb, appropriate electrical circuitry and a switch member having a fixed and a movable contact member are secured to the top and bottom body members in the cavity. The toy can be illuminated by rotating one of the body members with respect to the other to actuate the switch member so that the toy can be used in the dark.

BRIEF DESCRIPTION OF THE DRAWINGS

The description herein makes reference to the accompanying drawings wherein the like numerals refer to like parts throughout the several views, and in which.

DETAILED DESCRIPTION OF THE PREFERRED EMBODIMENT

Figure 1:
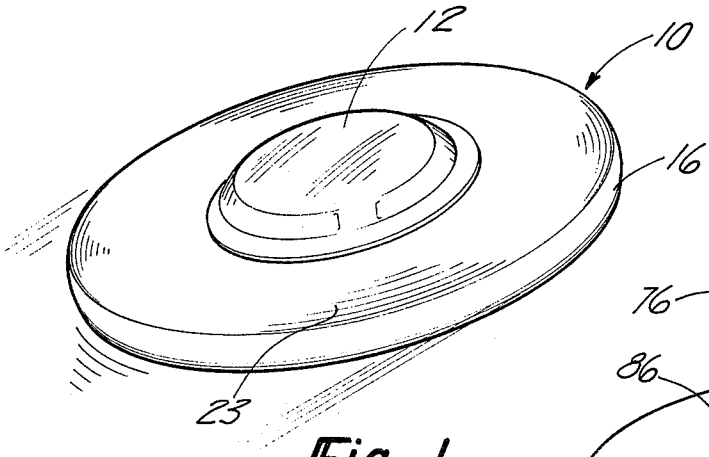
FIG. 1 is a perspective view of the flying body according to the present invention depicted as in free flight.

FIG. 1 shows a rotating free flight flying body 10, as if in flight. The flying body 10 is thrown into the air with a spinning impetus, thereby being caused to rotate about its geometric center and to translate generally in the direction in which it is thrown.

Figure 2:
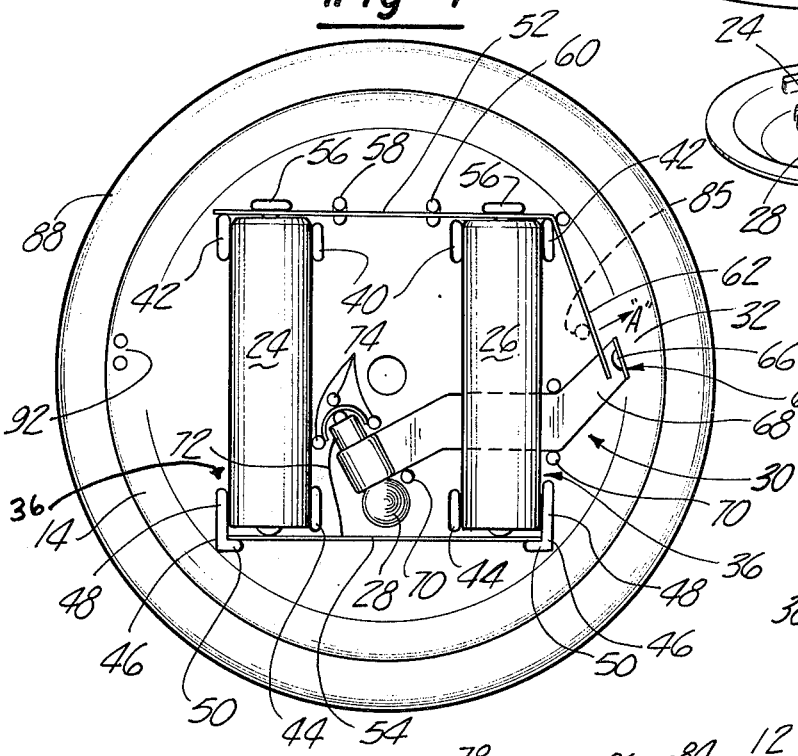
FIG. 2 is an exploded perspective view of the flying body of FIG. 1.
Figure 2:
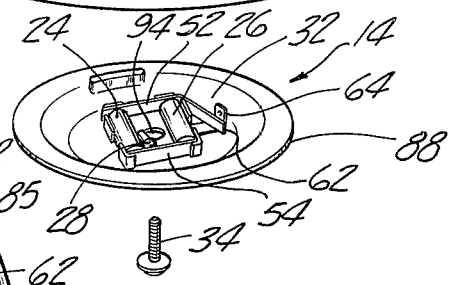

As can best be seen in FIG. 2, the flying body 10 comprises a top body member 12, a bottom body member 14 and a lifting body member 16. All three body members are saucer, or dish-like in shape. The top body member 12 and bottom body member 14 concavely face each other to define a closed chamber 18 (FIG. 3), and an open peripheral groove 20. The lifting body member 16 has a centrally disposed aperture 22, a peripheral portion 23 of the aperture 22 being received in the groove 20 to sandwich the portion 23 between the members 12 and 14, and to retain the lifting body member 16 in place concavely facing downwardly toward the bottom body member 14.

The lifting body 16 further comprises a plurality of concentrically disposed ridges 23 coaxially disposed on its convex surface. These ridges function as a spoiler to break up the boundry layer of air at the convex surface to increase lift.

Fastening means such as a screw 34 hold the top and bottom body members together.

Two dry cell batteries 24, 26, a light bulb 28, appropriate electric circuitry 30, and a switch means 32 are disposed in the chamber 18.

Figure 4:
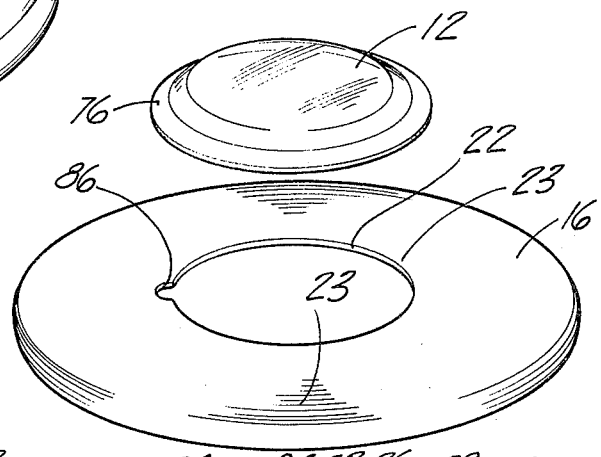
FIG. 4 is a top view of one of the components shown in FIG. 2.
Figure 3:
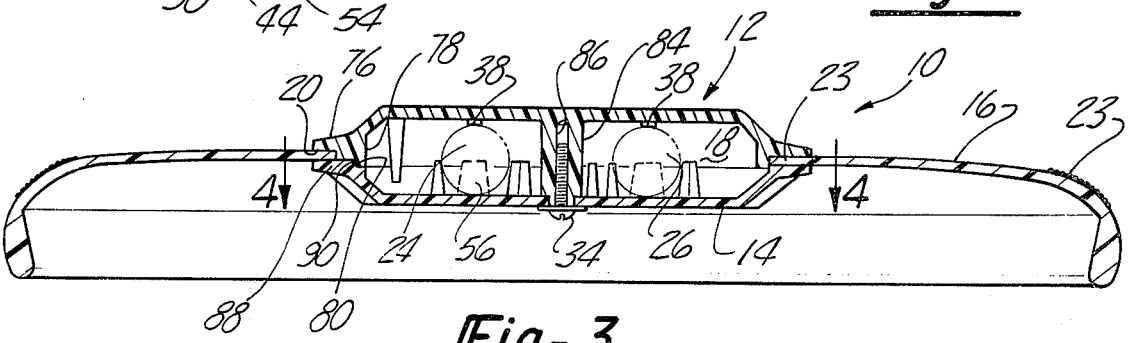
FIG. 3 is a sectional side view of the flying body.

As can best be seen in FIG. 4, the dry cell batteries 24, 26 are positioned equidistant from, and on opposite sides of, the geometric centerline of the flying body 10 so that they will balance. The dry cell batteries are retained in position by retaining means which comprise a pair of retaining pockets 36 and hold down pins 38 (FIG. 3).

Still referring to FIG. 4, the retaining pockets 36 each comprises four retaining projections 40, 42, 44 and 46, connected to and extending from the concave surface of the bottom member 14. Each projection 40, 42, 44 and 46 of each pocket 36 is disposed at a different corner of its respective battery 24 and 26. Each projection 46 is generally L-shaped having one of its legs 48 in abutting juxtaposition to the side of the batteries 24, 26 and the other of its legs 50 in spaced juxtaposition to the end of the batteries 24, 26.

The hold down pins 38 are connected to and extend from the concave surface of the top member 12. When the top member 12 is positioned on bottom member 14, the hold down pins 38 abut the sides of the batteries 24, 26 which face toward the top member 12 to force the batteries 24, 26 into their respective pockets 36 and against the concave surface of the bottom member 14.

Still referring to FIG. 4, the electric circuitry 30 comprises a first electrical conducting strip 52 traversing the pair of retaining pockets 36 across one end of the batteries 24, 26, and a second electrical conducting strip 54 traversing the pair of retaining pockets 36 across the other end of the batteries 24 and 26. Both strips 52 and 54 are in contact with the batteries 24 and 26.

The first electric conducting strip 52 is held in place across the one end of the batteries by a pair of projections 56, each disposed at one end of a different battery, a pair of first pins 58 and a pair of second pins 60. The projections 56, pins 58 and pins 60 are connected to and extend from the concave surface of the bottom body member 14. The pairs of first and second pins 58 and 60, respectively, are disposed between the batteries 24 and 26. The pins of the pair of first pins 58 and the pins of the pair of second pins 60 are spaced apart a distance approximately equal to the thickness of the first strip 52. Each end of the first strip abuts a different one of the retaining projections 42. The conducting strip 52 is disposed between the projection 56 and the batteries between the pair of first pins 58, and between the pair of second pins 60.

Each end of the second electric conducting strip 54 is disposed between the retaining projections 46, in the shoulder formed by its legs 48, 50 and the batteries.

The switching means 32 comprises a movable contact member 62 and a fixed contact member 64.

The movable contact member 62 comprises an arm attached at one of its ends to one end of the first strip 52. Preferably, the movable contact arm 62 is integrally formed with the first strip 52. The fixed contact member 64 comprises a fixed contact point 66 interconnected to the light bulb 28 by a conducting member 68. The conducting member 68 is held in place by a plurality of third pins 70 connected to and extending from the concave surface of the bottom body member 14 on both sides of the conducting member 68.

The light bulb 28 is disposed between the batteries 24 and 26, and is in electrical communication with the second conducting strip 54 by, for example, a wire 72. The light bulb 28 is held in place by means of a plurality of fourth pins 74 which are connected to and extend from the concave surface of the bottom body member 14.

Figure 5:
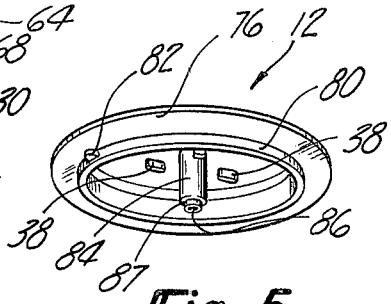
FIG. 5 is a perspective view of another one of the components shown in FIG. 2.

As can best be seen in FIG. 5, the top body member 12 comprises a radially extending flange 76 and a downwardly extending circumferential flange 78 (FIG. 3) disposed at 90° to the radial flange 76, which flanges cooperate to form a shoulder, generally denoted as 80. A locating projection 82 extends from the shoulder 80. A tubular member 84, having a threaded bore 86 is connected at one of its ends to, and projects from the concave surface at the geometric center of the top body member 12. The tubular member 84 has a circumferential shoulder 87 at its free end. A projection 85 extends downwardly from the body member 12 in a position to engage the side of the movable contact strip 62 as shown in phantom in FIG. 4.

The lifting body member 16 further comprises a locating aperture, such as a notch 86 open to the centrally disposed aperture 22 to receive therethrough the locating projection 82, thus locating the lifting body 16 relative to the top body 12.

As can best be seen in FIG. 3, the bottom body member 14 also comprises a radially extending flange 88 and a circumferential shoulder 90. The shoulder 90 receives a portion of the downwardly extending flange 78 of the top body member 12 such that the radially extending flange 76 of the top body member 12 is substantially parallel to and spaced from the radial flange 88, thus forming the peripheral groove 20. The bottom body member 14 includes a central aperture 94 which is coaxially aligned with the threaded bore 84 in the tubular member 82 when the top and bottom bodies are concavely facing each other.

The screw 34 is received through the aperture 94 in the bottom body member 14 and is threadedly engaged in the threaded bore 84 to fasten the three body members 12, 14 and 16 together.

To light the toy the top body member 12 and bottom body member 14 are rotated relative to each other to cause the projection 85 to rotate in a counterclockwise direction (FIG. 4) to engage the contact member 62 causing it to move outwardly, as indicated by the arrow A in FIG. 4, and to contact the fixed contact point 66, thus closing the electric circuit allowing current to flow therethrough to light the bulb 28.

Preferably, the top and bottom body members 12 and 14, respectively, are fabricated of a transparent or translucent plastic material to allow light transmission from the illuminated light bulb, and the lifting body member 16 is fabricated of a flexible plastic material able to withstand impacts.

The foregoing detailed description is given primarily for clarity of understanding and no unnecessary limitations should be understood therefrom, for modification will be obvious to those skilled in the art upon reading this disclosure, and may be made without departing from the spirit of the invention or the scope of the appended claims.

What is claimed is:

1. A rotating free flight flying body comprising a top body member and a bottom body member being dish like and concavely facing each other to form a chamber therebetween, a lifting body member disposed between and extending radially outwardly from the periphery of said top and bottom body members;

means fastening said plurality of body members together, lighting means disposed in said chamber, and switch means for selectively actuating said lighting means, said switch means comprising said top body member and said bottom body member being mounted to be rotatable relative to each other, and means actuating said lighting means upon relative rotation of said top and bottom member from a first position to a second position.

2. The flying body as defined in claim 1 and in which said lighting means comprises a power source and a light source energized by said power source.

3. A flying body as defined in claim 2, wherein:

said power source is at least two dry cell batteries; and said light source is a light bulb.

4. A flying body as defined in claim 3, further comprising:

a pair of retaining pockets for retaining said batteries in a predetermined location in said cavity on opposite sides of the geometric center of said flying body;

a first electrical conducting strip traversing said pair of retaining pockets at adjacent ends of said batteries;

a second electrical conducting strip traversing said pair of retaining pockets in spaced parallel relationship to said first electrical conducting member at the other adjacent ends of said batteries;

each of said batteries being in contact with said first electrical conducting element and said second electrical conducting element;

said switching means comprising a resilient movable electrical contact connected to said first electrical conducting member; and a fixed electric contact member operatively connected to said second electrical conductive member;

said resilient movable electric contact being movable into contact with said fixed electric contact to complete the electric circuit upon relative rotation of said top and bottom body members.

5. A flying body as defined in claim 1, wherein said bottom body member and said top body member cooperate to form a groove therebetween open to the periphery thereof, and said lifting body member has a central aperture therethrough concentric with the periphery of said lifting body, the portion of said lifting body defining the periphery of said aperture is received in said groove.

6. A flying body as defined in claim 1, further comprising a plurality of ridges formed in the convex surface of said lifting body member concentric to each other and to said lifting body member.

7. A flying body as defined in claim 1, wherein said top body member is fabricated of a light transmitting plastic material;

said two body members forming said closed chamber are fabricated of a light transmitting plastic material; and other of said body members is fabricated of a flexible plastic material capable of withstanding impact loads without breaking.

* * * * *